US007947237B2

(12) United States Patent
Belz et al.

(10) Patent No.: US 7,947,237 B2
(45) Date of Patent: May 24, 2011

(54) RACK SYSTEM

(75) Inventors: Renato Belz, Emmenbrucke (CH); Pius Emmenegger, Sarnen (CH)

(73) Assignee: Roche Molecular Systems, Inc., Pleasanton, CA (US)

( * ) Notice: Subject to any disclaimer, the term of this patent is extended or adjusted under 35 U.S.C. 154(b) by 912 days.

(21) Appl. No.: 11/175,908

(22) Filed: Jul. 6, 2005

(65) Prior Publication Data

US 2005/0281716 A1 Dec. 22, 2005

(30) Foreign Application Priority Data

Jun. 7, 2004 (EP) ..... 04015850

(51) Int. Cl.
*B01L 9/06* (2006.01)

(52) U.S. Cl. ..... 422/562; 422/560; 422/561; 435/809

(58) Field of Classification Search ..... 422/104, 422/560–562; 435/809
See application file for complete search history.

(56) References Cited

U.S. PATENT DOCUMENTS

| | | | | |
|---|---|---|---|---|
| 4,534,465 | A | 8/1985 | Rothermel et al. | |
| 5,098,663 | A * | 3/1992 | Berthold et al. | 422/104 |
| 5,137,693 | A * | 8/1992 | Mawhirt | 422/104 |
| 5,378,433 | A | 1/1995 | Duckett et al. | |
| 5,507,410 | A * | 4/1996 | Clark et al. | 221/171 |
| 5,858,310 | A * | 1/1999 | Jackson et al. | 422/102 |
| 5,985,215 | A | 11/1999 | Sakazume et al. | |
| 2002/0121139 | A1 | 9/2002 | Purpura et al. | |
| 2003/0133848 | A1 * | 7/2003 | Itoh | 422/104 |
| 2003/0161764 | A1 * | 8/2003 | Itoh | 422/104 |
| 2003/0206831 | A1 | 11/2003 | Stevens et al. | |

FOREIGN PATENT DOCUMENTS

| | | | |
|---|---|---|---|
| EP | 0469390 | A2 | 2/1992 |
| EP | 0469390 | A3 | 2/1992 |
| EP | 0510615 | A1 | 10/1992 |
| JP | 1214764 | A | 8/1989 |
| JP | 138528 | | 11/1989 |
| JP | 5062859 | A | 3/1993 |
| JP | 10239322 | A | 9/1998 |
| WO | WO 8300393 | A1 | 2/1983 |
| WO | 9400238 | A1 | 1/1994 |
| WO | 9514235 | A1 | 5/1995 |
| WO | WO 9627442 | A1 | 9/1996 |

* cited by examiner

*Primary Examiner* — In Suk Bullock
*Assistant Examiner* — Paul S Hyun
(74) *Attorney, Agent, or Firm* — Reza Savari; Olga Kay; Vivien Banholzer

(57) ABSTRACT

The invention provides a rack system containing an adapter for convenient application of small volumes of sample in a vessel to analysis.

17 Claims, 5 Drawing Sheets

RACK SYSTEM

This application claims the benefit of priority under 35 U.S.C. §119 of EP Application 04015850.3, filed Jul. 6, 2004, the contents of which are hereby incorporated by reference.

BACKGROUND OF THE INVENTION

1. Field of the Invention

Subject of the present invention is a disposable device, a rack for receiving an analytical tube vessel and a rack system for use in a fluid handling instrument.

2. Description of Related Art

Analytical processes have received some attention, particularly in the health care field. Determination of constituents of a liquid, and importantly of body fluids, like blood, has been improved to be very accurate. Furthermore, automation of the process steps involved has found widespread use. In addition, there has been a tendency to develop analytical processes that can work with very small volumes. In order to handle those tiny volumes, the disposables and the instruments for determining any analytes in said liquids are found to meet certain requirements that are not as important to meet in conventional devices and instruments. Furthermore, future processes will need to be much more convenient to be used by low-skilled personnel.

Conventional rack systems are based on a container that has portions adapted to receive vessels that contain certain volumes of sample fluid, primarily in the form of holes fitting to the diameter of the vessels. As most vessels have a circular diameter, the holes conventionally have a cylindrical form. Such rack is disclosed in WO 83/00393. There has been a trend to conduct several analyses on different samples in one instrument. The volumes required for such analyses may vary, dependent upon the number of analyses to be performed on one sample. In WO 96/27442 there is disclosed an adapter to be inserted into a cylindrical hole to reduce the diameter of the hole, such that even smaller tubes can be securely contained in said hole.

It was an object of the present invention to improve the conventional rack systems, particularly to better serve the needs of automated processing by instruments for handling small volumes.

SUMMARY OF THE OF THE INVENTION

Subject of the invention is a rack system for use in a fluid handling instrument comprising

- a container portion having at least one hole for receiving a substantially cylindrical body, which hole is longer than wide and
- a substantially cylindrical tube vessel at least partially located in the hole, the vessel having an outer diameter substantially smaller than the inner diameter of hole, and
- an adapter element defining a cavity for receiving the vessel wherein the adapter element comprises a flexible central stem portion extending from the bottom of the hole to at least one half of the hole.

Another subject of the invention is a rack for receiving at least one analytical tube vessel comprising

- a container portion having at least one hole for receiving a substantially cylindrical body which hole is longer than wide and
- an adapter element defining a cavity for receiving the analytical tube vessel, the vessel having an outer diameter substantially smaller that the inter diameter of the hole, wherein said adapter element comprises a flexible central stem portion extending from the bottom of said hole to at least one half of said hole.

Still another subject of the invention is a disposable device containing a

- substantially cylindrical retainer having first and second openings and
- a closable tube vessel for receiving a liquid positioned within the first opening, wherein the tube vessel is firmly fixed to the interior of the retainer.

Still another object of the invention is an insert for closing a hole designed to receive a sample in a rack system, comprising an upper part for closing the hole and a side part containing a label indicating that the hole does not contain a sample vessel.

DETAILED DESCRIPTION OF THE INVENTION

Figure 1:
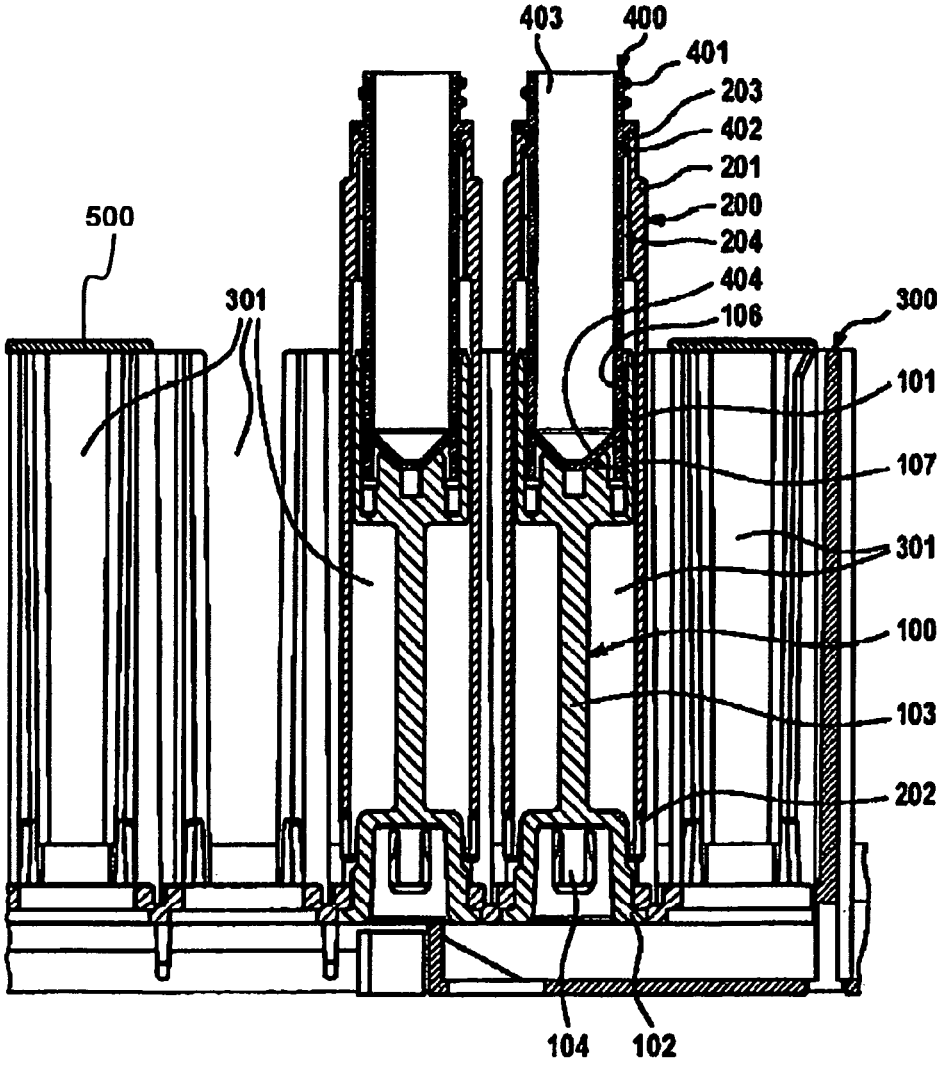
In FIG. 1 there is shown a part of an exemplary rack system according to the invention in longitudinal cut view.

Vessels are essentially cylindrical containers, some containing a bottom of diameter reduced compared to the main body of the vessel. They are frequently called tubes or tube vessels. They have a chamber for receiving a volume of liquid to be analyzed, i.e. the sample. The volume of the chamber depends upon the volume of the sample and may vary from 10 μl to 5 ml. Tubes may be made from conducting materials, preferably by electrical conducting plastics, such as polypropylene (Pre-Elec TP 6735, by Riwisa AG, Hägglingen, Switzerland). Tubes designed to contain a sample usually are equipped with a cap, either connected to the tube or provided independently. The cap is used to prevent spilling of the reagent into the environment, to prevent the sample from becoming contaminated by other samples, and to prevent liquid evaporation.

Racks are well known containers to introduce a defined number of vessels to an instrument. Usually, racks contain between 4 and 96 holes to accommodate an equal or lower number of vessels. The width of the holes in the rack therefore depends upon the form of the vessel or tube and is larger than the diameter of the tubes to be held by the rack and is smaller than the length of said hole. Convenient diameters of the holes vary from 20 mm to 2 mm. The holes do not need to exactly fit the outer form of the tubes, but rather contain means to guide the tubes to a predetermined position in the hole, i.e. the rack. Those means are for example springs, either made from metal or from plastics, preferably from the same material as the rack. Racks are preferably non-disposable tools made of plastics, preferably of polybutylene terephthalate/20% Glass Beane electrically conductive (RTP 1099x92019 black, by Dolder AG, Basel, Switzerland). They can have any desired form. According to the invention, the rack is a container with substantially long shape, holes being arranged in rows along one side, preferably the upper side, of the container, extending through the body of the container to the opposite side, the bottom side, of the container. On that side, the hole is narrowed or closed so that the vessel contained therein cannot escape the rack. The hole may have recesses or slots to its side, but narrow so that again, the vessel cannot escape the rack.

Sample volumes may vary between 10 μl and 2 ml, preferably between 50 μl and 500 μl. A particular kind of sample is a liquid control reagent. Such control reagent contains a predetermined amount of analyte and is used to check whether the analysis is working correctly. For quantitative determinations, two or more control reagents with different concentrations of the analyte are provided for each analyte to be determined. They are used to create a calibration curve, correlating the concentration of the analyte with a signal measured in the test. Controls can contain the same analyte as the sample, but the control can also use an artificial analyte, i.e. a compound that mimics the analyte in the assay by behaving similar as the analyte.

In the present invention, the tube vessel is substantially smaller in diameter than the hole of the rack, i.e. the tube contains a small volume of sample or control reagent. Prior to the invention, is has been difficult to contain and process such small volumes in the same process as the samples containing unknown amounts of analyte. In order to present the control reagent appropriately to the liquid handling robotics of the analytical instrument, the rack system according to the invention comprises a rack containing an adapter and a disposable device containing a tube vessel and a retainer.

A part of an exemplary rack system is shown in longitudinal cut view in FIG. 1. The system contains the container (300) with holes (301). Preferably, the container (300), preferably at the bottom of the hole, contains means to receive the adapter or/and the retainer in a predetermined, locked position; such means contain means to complement and fit to corresponding fitting means in the adapter and the retainer. Such means may include snap-in means, like noses, springs, recesses, or elastic elements, like knobs and rims. The fitting means (302, not shown) to fit to the adapter are preferably means to avoid rotation of the adapter within the hole or/and fix the adapter to the container, such that it cannot escape the hole. Means to fix the retainer (303) may comprise elements to avoid rotation of the retainer within the hole. Such means may comprise one or more teeth or recesses fitting to recesses or teeth of the retainer. Preferably, fixing means (303) are means to reversibly fix the retainer in a predetermined position within the hole. This means are constructed to fit to complementary corresponding elements on the retainer, e.g. tooth means. Furthermore, the container can comprise means to attach additional elements either inside or outside of the hole. Those means may comprise slides, knobs, rims, teeth, recesses or the like. For example, a slide (304) can be used to attach an insert device for closing a hole designed to receive a sample in the container. In addition, the container may comprise snap-in means (305) to fix the insert device in a predetermined position. This position preferably will be located such that a side part (501) of the insert containing a label indicating that the hole does not contain a sample or control vessel insert can be read by a reading device. Practically, the rack system further contains positioning means (not shown) to position the container in an analytical instrument. Such instruments usually require that sample vessels are provided in a predetermined position in order to be reliably accessible by handling means, such as pipettes or grippers of the instrument. Those positioning means preferably are slides or complements thereof, like rails, on the bottom of the rack. If a slide or rail is provided on the instrument, a complement of a slide or rail, like another slide or rail or knobs, are provided on the rack.

FIG. 1 shows one open, empty hole, two empty, but closed holes and two holes equipped with an adapter (100), a retainer (200) and a vessel (400). The vessel has a screw thread (401) for closing the vessel with a screw cap, a rim (402) for fixing the vessel in the retainer, a chamber (403) for receiving the sample and a bottom surface (404) to be accommodated with a corresponding surface of the adapter.

The retainer (200) has a snap-in means (203) for locking the vessel in the cylindrical interior of the retainer and tooth means (202) to avoid twisting of the retainer versus the bottom of the hole, or the adapter.

The adapter (100) (the arrow points to the stem portion to label the adapter in full) contains a stem portion (103), snap-in means (104) for securing the adapter versus the bottom of the hole and surfaces (107) for accommodating the corresponding surfaces of the vessel providing conductive connection between adapter and vessel.

The adapter element according to the present invention contains a cavity for receiving the vessel. Therefore, preferably the adapter element has an inner form to resemble at least a part of the outer form of the vessel. Said cavity may be as small as 1 mm, but preferably is between 2 and 20 mm long, measured along the long axis of the tube vessel. More specifically, the adapter element contains a surface adapted to contact the tube, preferably the bottom part of the vessel. The adapter element is preferably made of a conductive plastics material, like polybutylene terephthalate/20% Glass Beane conductive (RTP 1099x92019 black, by Dolder AG, Basel, Switzerland). The adapter element further contains a flexible central stem portion. The cavity and the stem portion are arranged such that in the finally assembled rack, the stem portion extends from the bottom of the hole in the rack to at least one half of the hole. The purpose of the stem portion is the function of a means for carrying the vessel in the hole of the rack in a horizontally flexible, but centrally self adjusting manner. The stem is preferably made from the same material than the other parts of the adapter element. The stem may have a length and thickness to be sufficient to allow vertical movement within the hole of the rack, but turn back to the central position with the vessel it carries. The adapter further assures that the same rack geometry can be used for sample tubes with generally larger volume and controls with smaller volume. The adapter element is an element of the rack and thus can be reused in subsequent analyses, equipped with other tube vessels or samples. Thus, the adapter may be removed from the rack, but preferably is an integral element of the rack and may be removed only when the rack is disintegrated. The adapter is preferably firmly fixed to the bottom of the hole in the rack. Firmly affixed means that the adapter cannot be irreversibly twisted in said hole without damaging the form of the adapter or the means fixing the adapter in the hole.

Figure 2:
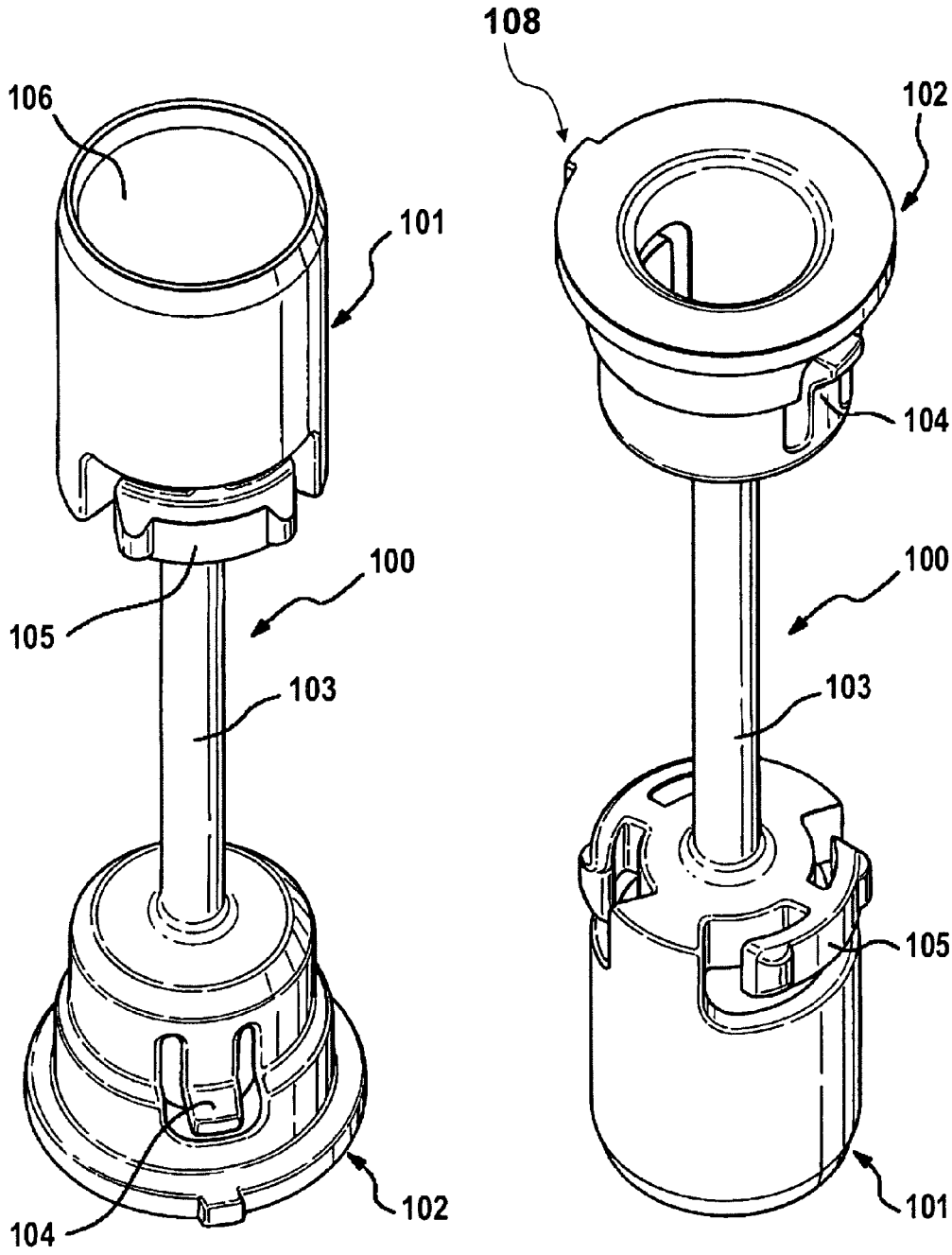
In FIG. 2 there is shown an exemplary adapter according to the invention.

An exemplary adapter element is shown in FIG. 2. The figure shows the same device seen from two sides, an upper part and a bottom part. The adapter (100) has an upper part (101) and a bottom part (102). Those parts are linked by the stem part (103). The lower part contains snap-in means (104) to fix the device to the bottom of the rack. Furthermore, the bottom part has fitting means (108) to provide that the adapter is fixed to the rack in a predetermined position without substantial possibility to rotate around its longitudinal axis. The rack preferably has a complementary fitting means (not shown) to fit to the fitting means (108) of the adapter. The upper part contains springs (105) to fix the adapter to the retainer. The upper part contains a cavity (106) to receive the vessel.

Preferably, for manufacturing the rack system, the adapter element is inserted into the hole of the rack through a hole on the bottom of the rack, which is just as large as to allow the upper part with the stem portion of the adapter element to enter the hole, but have a width to be complementary to the lower part of the adapter element containing the fitting elements (108). By inserting the adapter to the final position from below the rack, the fixing means (104) and fixing means (302, not shown) engage and fix the adapter to the rack in the hole.

The retainer of the present invention is a disposable element that has substantially cylindrical form mimicking the form of a tube vessel. It has the function to retain the vessel such that it fits into the hole of the rack. Thus, the retainer has an outer diameter which is substantially smaller than the inner diameter of the hole of the rack, but larger than the outer diameter of the tube vessel. Substantially means that there is a space around the outer surface of said retainer and the inner surface of said hole. This space allows limited vertical movement of the retainer within said hole. The lower part of the retainer (202) preferentially does not reach to the bottom of the hole and is toothed to means for fixing the retainer (303) in order to allow for limited radial movement of the retainer within said hole. Conveniently, the retainer has a tubular form, with first and second openings, the first opening being adapted to receive the vessel, defining the upper end of the cylinder, the second opening being the lower end, pointing to the bottom of the hole in the rack. The retainer preferably contains a label, more preferably a bar code label. This label can be used to label and identify the tube vessel and its content, for example to indicate the kind of control or analyte contained in said vessel. The label is applied such that it can be recognized or read from outside the rack or container, for instance through a slot, recess or hole in the rack. This is very advantageous to use a retainer if the sample vessel is so small that it barely has sufficient surface to carry the necessary amount of data. The label can be applied by printing with an ink or by affixing a self-adhesive paper with the pre-printed label to it. Preferably, the retainer extends from outside of the hole up to the majority of the length of the hole within the rack. The length extending over the hole is preferably not more than 30% of the overall length of the retainer. The retainer may extend over the length of the vessel and more preferably over 80% of the length of the adapter element. Most preferably, the retainer at its lowest part contains means to fix the retainer in a twist fit mode, i.e. to prevent the retainer from twisting against the hole by contacting the rack on the bottom of the hole, without preventing the retainer from vertical movement within the hole as allowed by the inner diameter of the hole. The twist fit can be ascertained for example by a gear rim around the circumference of the lower end of the retainer pointing to the bottom of the hole and a corresponding gear rim on the bottom of the hole of the rack.

More preferably, the retainer contains means to reversibly fix the retainer to the adapter element. Such reversibly fixing means are for instance springs made from plastics or metal, provided either on the surface of the retainer pointing to the adapter or on the surface of the adapter element pointing to the retainer. The means can also be snap-in means. Furthermore, the retainer may also comprise means to avoid rotation of the retainer within the hole. This in combination with means to fix the vessel within the retainer means and optionally means to fix the adapter in the hole is advantageous in order to allow reliable opening of screw caps on the vessel. The retainer is preferably made by a cheap material, for example polystyrene butanediene. The retainer is preferably made by a cheap, disposable material.

Figure 3:
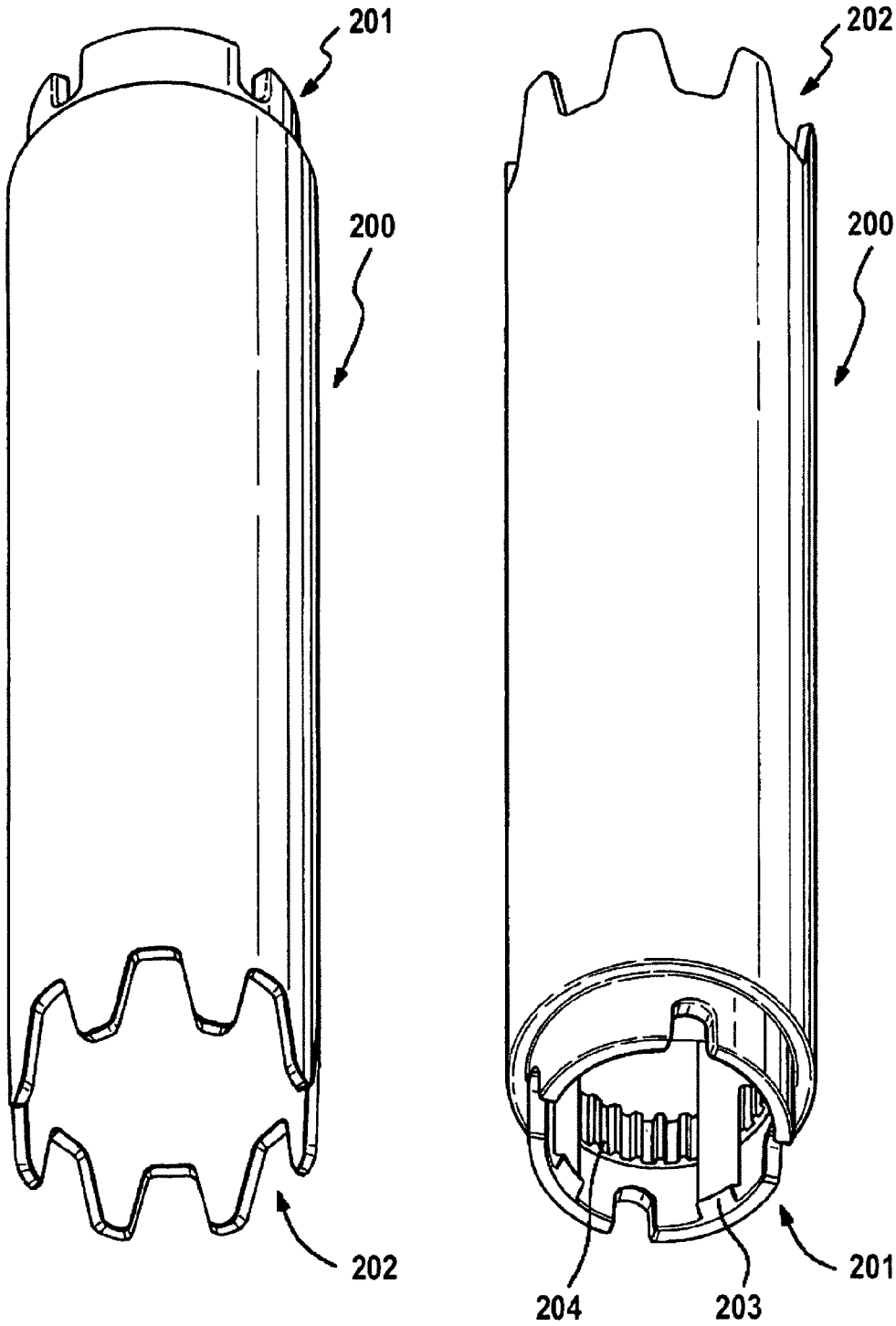
In FIG. 3 there is shown an exemplary retainer according to the invention.

An exemplary retainer is shown on FIG. 3. The figure shows the same retainer (200) seen from the top and from the bottom. The retainer has an upper part (201) and a lower part (202). The upper part has one or more protrusions (fixing means, 203) to engage with a rim in the vessel. Furthermore, the retainer has splines (fixing means, 204) to avoid twisting of the vessel within the retainer.

In another object of the invention, any empty holes, i.e. holes not containing a sample or control reagent, are closed using an insert for closing the upper part of the hole in the rack designed to receive a sample vessel or control vessel in a rack system, comprising an upper part for closing the hole and a side part containing a label indicating that the hole does not contain a sample vessel. This insert can favorably be used in cases, where it is not intended to analyse as many samples as can be contained in the rack, for instance, in case of a 24 hole rack, there may be only 16 samples and 4 controls in 20 holes. The remaining 4 holes may be closed by inserting 4 inserts at the empty locations, i.e. inserting the inserts into the holes.

The insert can be manufactured by any plastics material and may be disposable or non-disposable. It has two functions, first to close the hole so that no sample or control can be inserted by chance, and second to indicate to the user or the instrument used for automated analysis, that the particular position does not need any analyses. For example, the respective position will then not be subjected to a pipetting process. If the label would not have indicated to the instrument that the hole is empty and closed, the pipetting device may be damaged when hitting the closure.

The shape of the insert may be adapted to the particular functions. For secure fixing the insert in the rack, the insert may mimic the form of the hole, i.e. the form of the vessel normally contained. In another embodiment, the insert may have guide means to position the insert in any rack walls. The closure part of the insert may be a flat upper part of the insert, essentially covering the hole from the top, such that no sample vessel can be inserted into the hole by any user. The label part can be applied to any position visible for human or, preferably by instrument when seeing the rack. For automated labeling, the label is preferably a bar-code. This can readily be read by a bar-code reader when inserting the rack into the instrument. Such bar-code readers are generally known for reading labeling positions of the rack containing samples. Preferably, in addition to guides, the insert device contains fixing means to fix the insert device in the predetermined position. This allows more reliable reading of the label. The advantage of the insert of the present invention is that it can be inserted at any desired position on the rack, i.e. in any hole.

Figure 4:
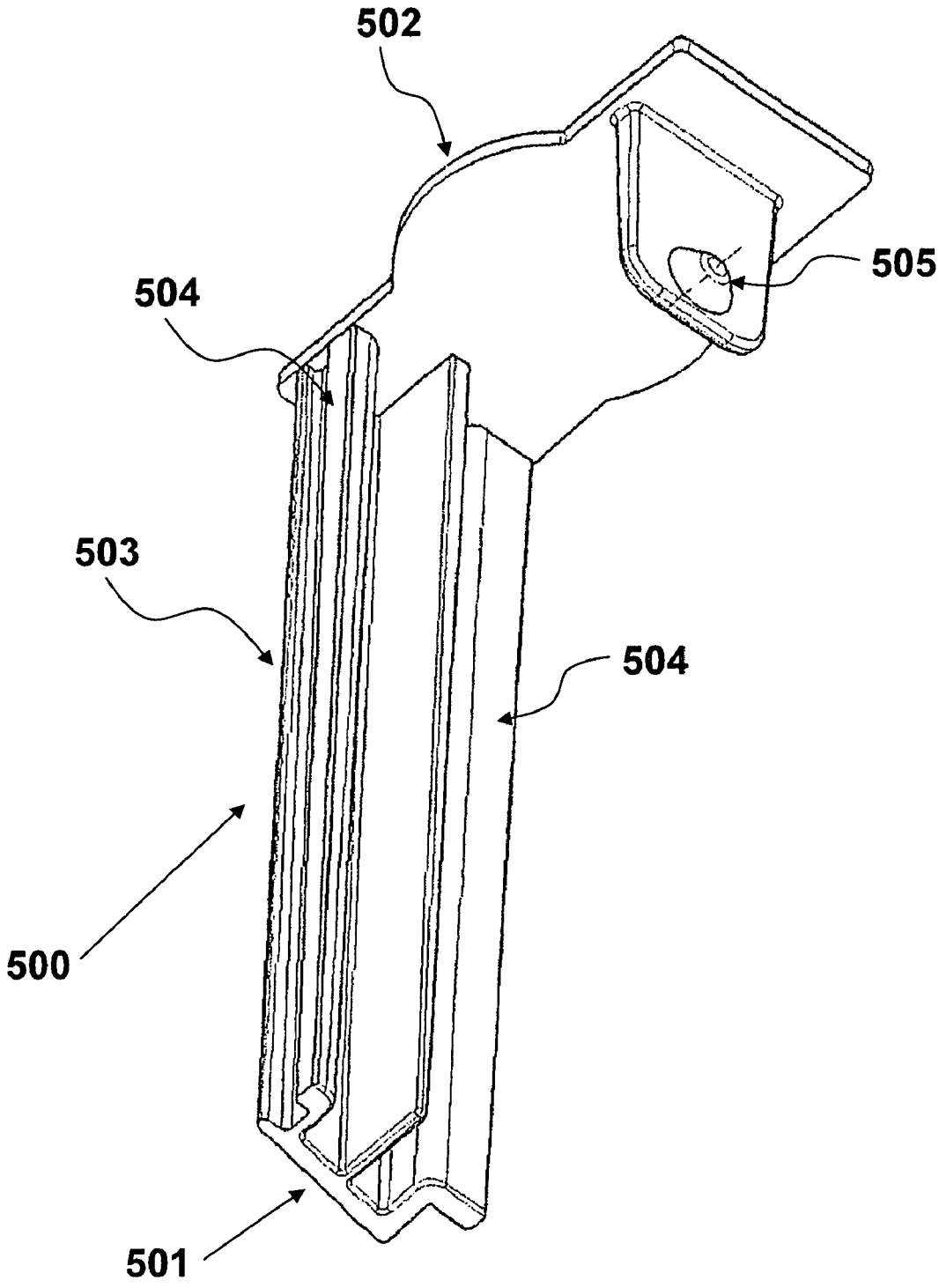
In FIG. 4 there is shown an exemplary insert device according to the invention.

In FIG. 4, a preferred insert device (500) is shown. The label part (501) extends substantially perpendicularly from the closure part (502). It has an outer area (503) to contain the label. Further it contains guide means (504) complementary in form to respective guides in the rack. In the embodiment shown, the guides are provided on the label part, which is preferred. However, the guides can also be provided independently from the label part at any other position coming into contact with or reaching into the rack. In a preferred embodiment, the middle section of the closure portion of the insert (502) is roundly shaped and its dimension is chosen to at least fully cover the hole (301). Furthermore, the closure portion of the insert (502) may comprise tabs slightly expanding over the edge of the rack in order to allow for a better removal of the insert device (500) from the rack. Also shown in FIG. 4 is a fixing means (505) to secure the device within the rack.

Shown is a means in the form of a knob located at a position complementary to a recess in the hole of the rack.

Figure 5:
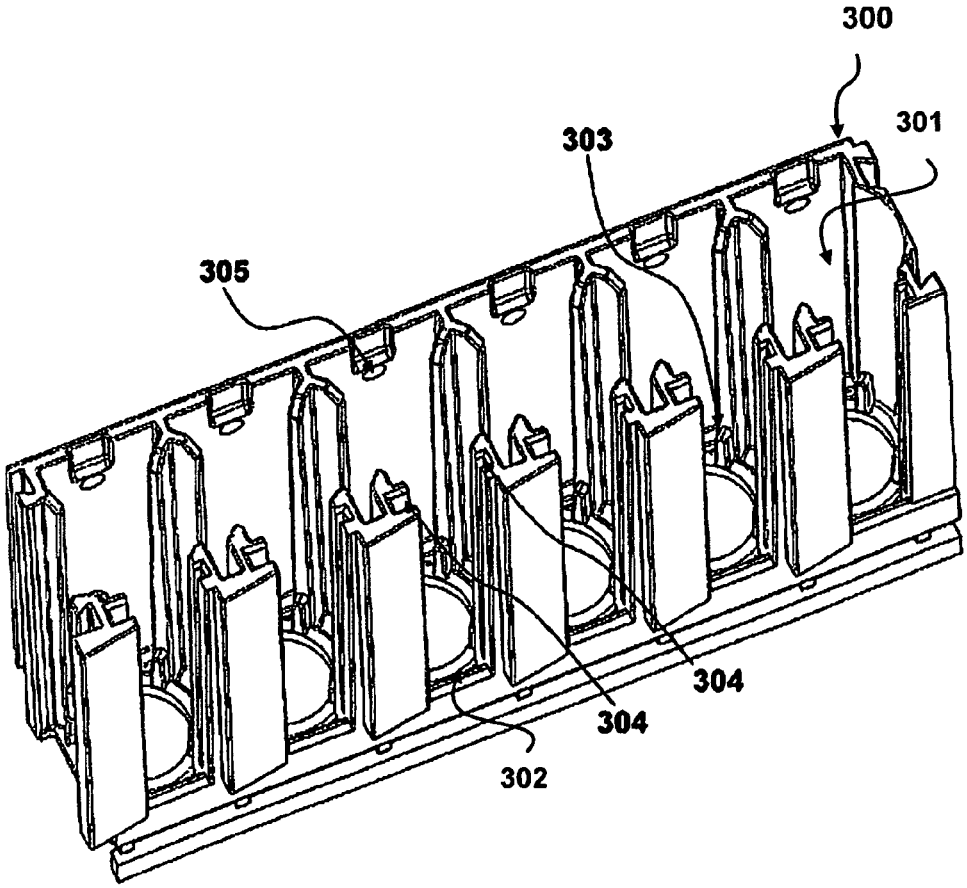
In FIG. 5 there is shown an exemplary rack according to the invention seen from above.

FIG. 5 shows an exemplary rack seen from above. Details shown comprise fixing means (303) for the retainer, guides (304) to position the insert device, and fixation recesses (305) to complement a knob on the insert device. In the case shown, those recesses are holes in the wall of the rack. In a preferred embodiment, a metal rail is embedded into the bottom plate of the rack in order to enhance its stability.

All devices or parts of it can conveniently be prepared by injection moulding. This may require preparation in parts and subsequent assembly of the parts to yield the complete device. Such methods are well known in the art. Parts of the assembly which are not intended to be separated after assembly can easily be connected by snap-in means. Preferably, the adapter is inserted into the hole of the rack from the bottom until the snap-in means have snapped in and thus locked the adapter within the rack.

In the first embodiment, the invention is directed to a device which contains the retainer and the vessel. The retainer and the vessel are preferably linked together such that they cannot be separated without disrupting at least one of the parts. The linkage can be made in any way, preferably by snap-in means on the two parts. This is important, as the reliable linkage assures that the retainer cannot be reused to be fixed to an unrelated vessel. This avoids mix-up of the test results achieved with the control reagents contained in the vessel. When ready for use in analysis, the device will further contain a control reagent in the vessel, the vessel being closed by a cap, such that the reagent cannot escape the vessel prior to use. The device will contain a label indicating the kind of reagent contained.

In the second embodiment, the invention is directed to the rack containing a container portion and the adapter element. This part of the rack system is non-disposable and can be used in subsequent runs of analysis on the instrument. The adapter element is firmly fixed to the rack within the hole.

In the third embodiment, in use in an analytical process, the rack system according to the invention is prepared by the customer by putting one or more of the disposable devices into the rack.

In an analytical process, the rack system will be placed on an analytical instrument and the analysis is started. During the analysis, a certain predetermined amount of reagent is taken from the vessel and subjected to analysis. The aspiration of the correct volume of liquid can be controlled by capacitive liquid level detection. This principle is known in the art, but the present invention greatly improves its application to the liquid handling of control reagents. For this purpose, the vessel and the adapter are made of conductive material and the capacity between a pipette tip and the bottom of the adapter is measured. A drop of capacity during downward movement of the pipette tip indicates that the tip has touched the surface of the liquid control reagent in the vessel.

In an exemplary embodiment, the instrument for analysis is the COBAS AmpliPrep (Roche Diagnostics GmbH, Mannheim Germany). The rack system is inserted into the slot designed for control reagents.

While the foregoing invention has been described in some detail for purposes of clarity and understanding, it will be clear to one skilled in the art from a reading of this disclosure that various changes in form and detail can be made without departing from the true scope of the invention. For example, all the techniques and apparatus described above can be used in various combinations. All publications, patents, patent applications, and/or other documents cited in this application are incorporated by reference in their entirety for all purposes to the same extent as if each individual publication, patent, patent application, and/or other document were individually indicated to be incorporated by reference for all purposes.

REFERENCE NUMERALS

100 Adapter
101 Upper part of adapter
102 Bottom part of adapter
103 Stem portion of adapter
104 Snap-in means
105 spring
106 cavity
107 Contact surface on adapter
108 Fitting means of the adapter to the rack
200 Retainer
201 Upper part of retainer
202 Lower part of retainer
203 Protrusions or snap-in means of retainer
204 Splines of retainer
300 Container
301 Hole
302 Means for fixing the adapter element
303 Means for fixing the retainer
304 Guide for positioning the insert device
305 Recess for fixing the insert device
400 Vessel
401 Screw thread
402 Rim
403 Chamber for receiving the sample
404 Bottom of vessel
500 Insert device
501 Label part of the insert
502 Closure portion of the insert
503 Outer area
504 Guide means
505 Fixing means for the insert device

The invention claimed is:

1. A rack system for receiving at least one analytical tube vessel, comprising:

a container portion having at least one hole for receiving at least one analytical tube vessel, which hole is longer in one dimension than in another, an adapter element having an upper portion defining a cavity for receiving said analytical tube vessel and a bottom portion, said adapter element comprising a flexible central stem portion linking the upper portion and the bottom portion of the adapter, said stem portion extending from the bottom of said hole to at least half the length of said hole, a substantially cylindrical tube vessel at least partially located in said hole, said vessel having an outer diameter substantially smaller than the inner diameter of said hole, and a disposable retainer element of substantially cylindrical shape at least partially located in said hole and being removably connected to said tube vessel and said adapter element, said retainer element extending to the space outside of the hole.

2. A rack system according to claim 1, wherein said rack system further contains a machine readable tag indicating the identity of said rack system.

3. A rack system according to claim 1, wherein the width of said hole is substantially larger than the outer diameter of said analytical tube vessel.

4. A rack system according to claim 1, wherein said adapter element exerts pressure on an inner wall of said retainer.

5. A rack system according to claim 1, wherein said element has a surface adapted to contact said tube vessel contained in said adapter.

6. A rack system according to claim 1, wherein said adapter is electrically conductive.

7. A rack system according to claim 1, wherein said adapter is firmly fitted into the hole in said container portion.

8. A rack system according to claim 1, wherein the outer diameter of said retainer is substantially smaller than the inner diameter of said hole.

9. A rack system according to claim 1, wherein said retainer element extends over the length of said adapter.

10. A rack system according to claim 1, wherein said retainer comprises a bar code label.

11. A rack system according to claim 1, wherein said retainer element is connected to said adapter element in force-fit.

12. A rack system according to claim 1, wherein said vessel extends to the space outside of the hole.

13. A rack system according to claim 1, wherein said retainer extends to the bottom of the hole.

14. A rack system according to claim 1, wherein said retainer element is capable of vertical movement within said hole.

15. A rack system according to claim 1, wherein said vessel contains a liquid control reagent.

16. A rack system according to claim 1, wherein the substantially cylindrical retainer comprises first and second openings and tooth means at the second opening, and the tube vessel comprises a closable tube vessel for receiving a liquid positioned within said first opening, said vessel comprising a screw thread, said tube vessel being firmly fixed to the interior of said retainer, wherein said retainer and said vessel are fixed by splines on the retainer and a rim on the vessel to avoid twisting.

17. A rack system according to claim 16, wherein said retainer and said vessel are configured in a twist fit mode within said hole.

* * * * *